US005176088A

United States Patent [19]

Amrhein et al.

[11] Patent Number: 5,176,088

[45] Date of Patent: Jan. 5, 1993

[54] FURNACE AMMONIA AND LIMESTONE INJECTION WITH DRY SCRUBBING FOR IMPROVED SIMULTANEOUS $SO_X$ AND $NO_X$ REMOVAL

[75] Inventors: Gerald T. Amrhein, Louisville; Stanley J. Vecci; John M. Rackley, both of Alliance, all of Ohio

[73] Assignee: The Babcock & Wilcox Company, New Orleans, La.

[21] Appl. No.: 819,248

[22] Filed: Jan. 10, 1992

[51] Int. Cl.[5] ..... F23J 11/00; F23J 15/00

[52] U.S. Cl. ..... 110/345; 110/216; 422/169; 422/172; 423/235

[58] Field of Search ..... 110/342, 344, 345, 216; 422/169, 171, 172; 423/235

[56] References Cited

U.S. PATENT DOCUMENTS

| | | | |
|---|---|---|---|
| 3,900,554 | 8/1975 | Lyon | 423/235 |
| 4,197,278 | 4/1980 | Gehri et al. | 423/242 |
| 4,208,386 | 6/1980 | Arand et al. | 423/235 |
| 4,279,873 | 7/1981 | Felsvang et al. | 423/242 |
| 4,288,420 | 9/1981 | Ito et al. | 423/239 |
| 4,372,770 | 2/1983 | Krumwiede et al. | 110/345 X |
| 4,616,576 | 10/1986 | Engstrom et al. | 110/345 |
| 4,824,360 | 4/1989 | Janka et al. | 110/345 X |
| 4,956,161 | 9/1990 | Caan et al. | 423/235 |
| 5,029,535 | 7/1991 | Krigmont et al. | 110/345 |
| 5,058,514 | 10/1991 | Mozes et al. | 110/345 |
| 5,078,973 | 1/1992 | Kuroda et al. | 423/235 X |

FOREIGN PATENT DOCUMENTS

| | | | |
|---|---|---|---|
| 3407689 | 9/1985 | Fed. Rep. of Germany | 110/345 |

OTHER PUBLICATIONS

Nolan, Paul S. and Hendriks, Robert V., *Initial Test Results of the Limestone Injection Multistage Burner* (LIMB) Demonstration Project, 81st Annual Meeting of the Air Pollution Control Association, Dallas, Tex., Jun. 20-24, 1988.

Yagiela, A. S. et al., The DOE Sponsored LIMB Project Extension and Coolside Demonstration, Energy Technology Conference & Exposition, Washington, D.C., Feb. 18, 1988.

Liang, A. D. et al., Potential Applications of Furnace Limestone Injection for $SO_2$ Abatement, Coal Technology Conference Houston, Tex., Nov. 13-15, 1984.

*Primary Examiner*—Edward G. Favors

*Attorney, Agent, or Firm*—Vytas R. Matas; Robert J. Edwards; Daniel S. Kalka

[57] ABSTRACT

A process and apparatus for simultaneously removing $NO_X$ and $SO_X$ from the exhaust of a furnace includes an injection of limestone into a region of the furnace having a temperature of about 2,000°-2,400° F., and an injection of ammonia into a region in the furnace having a temperature of about 1,600°-2,000° F. The limestone absorbs at least some of the $SO_X$ and the ammonia absorbs at least some of the $NO_X$. The exhaust from the furnace which contains particulate and gases, is supplied to a dry scrubber where further reactions take place between unused ammonia and $SO_X$, and calcium sorbent and $SO_X$. Sorbent and ammonia regeneration can also be utilized to further improve the efficiency of the system.

7 Claims, 1 Drawing Sheet

STACK
26
ASH RECYCLE
WASTE
30
AMMONIA REGENERATION
PARTICULATE COLLECTOR
A+-LIDS
24
150°F
18
DRY SCRUBBER
17
AH
300°F
NH3 RECYCLE
32
WATER
28
SLURRY TANK
34
36
22
FURNACE
12
1800°F
20
2200°F
10
COMBUSTION ZONE
AMMONIA
14
LIMESTONE
16
COAL

FURNACE AMMONIA AND LIMESTONE INJECTION WITH DRY SCRUBBING FOR IMPROVED SIMULTANEOUS $SO_X$ AND $NO_X$ REMOVAL

FIELD AND BACKGROUND OF THE INVENTION

The present invention relates in general to furnace and post combustion emission control technology, and in particular to a new and useful process of simultaneously reducing both $SO_X$ and $NO_X$.

Selective non-catalytic reduction (SNCR) is known for controlling $NO_X$ by injecting ammonia in the furnace downstream of the combustion zone.

Limestone injection dry scrubbing (LIDS) is also known whereby $SO_X$ is reduced by injecting limestone or other sorbent in the furnace downstream of the combustion zone and by injecting a calcium-based sorbent into a dry scrubber system attached to the outlet of the furnace system. To date, these two techniques have never been combined nor have the advantages of their combination been described or suggested.

SUMMARY OF THE INVENTION

An object of the present invention is to provide a process for the simultaneous removal of $NO_X$ and $SO_X$ from the exhaust of a furnace having a combustion region, a first injection region at a temperature of 2,000°-2,400° F. and a second injection region at a temperature of 1,600°-2,000° F., the process comprising the steps of injecting a calcium based sorbent into the first injection region in an amount sufficient to absorb at least some $SO_X$ generated in the combustion region, injecting ammonia into the second injection region in an amount sufficient to react with and reduce by at least 50% the $NO_X$ generated in the combustion region to produce an exhaust containing gas and particulate material, supplying the exhaust to a dry scrubber where unreacted ammonia in the exhaust reacts with unabsorbed $SO_X$, and supplying an output from the dry scrubber to a particulate collector for separating particulate from gas.

A further object of the present invention is to recycle a portion of the particulate to a slurry tank where unused calcium containing absorbent is mixed with water and returned to the dry scrubber to remove more of the unabsorbed $SO_X$.

A still further object of the invention is to add water to the particulate removed from the particulate collector to regenerate ammonia, and return the generated ammonia to the dry scrubber or furnace.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
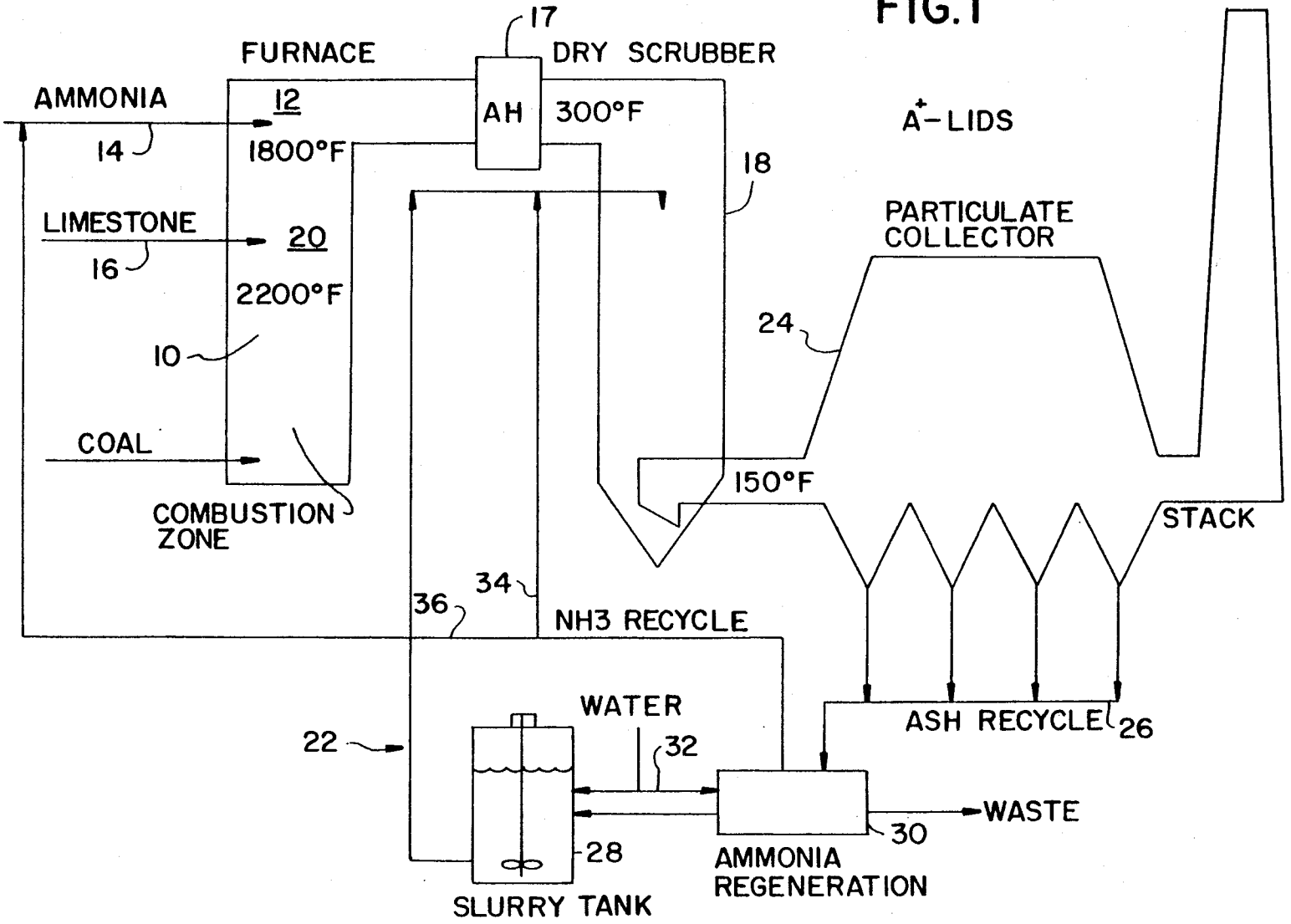
FIG. 1 is a schematic diagram showing a system used to practice the process of the present invention.

The process of the present invention provides a potentially low-cost, efficient method of simultaneous $NO_X/SO_X$ removal that also improves the efficiency of the boiler heat cycle. Such a low-cost, low risk, efficient $NO_X/SO_X$ system may be attractive to utilities which must meet the pollution control standards passed in the Clean Air Act of Nov. 1990.

The process involves combining the technologies of selective non-catalytic reduction (SNCR) and limestone injection dry scrubbing (LIDS). The result is a new and superior process that solves the problems of the individual technologies through unexpected interactions. The process should be capable of <50% $NO_X$ reduction and 95% $SO_2$ reduction at a furnace $NH_3/NO_X$ molar ratio near one and a furnace Ca/S molar ratio between 1-1.5. Boiler heat cycle efficiency may also be improved by as much as 1.5%.

A process schematic is shown in FIG. 1. The major overall chemical reactions are listed in Table 1. Referring to this figure and the table, a brief description of a stand-alone SNCR and LIDS process is given, followed by a description of the combined process.

An SNCR system controls $NO_X$ and involves injecting ammonia ($NH_3$) or any ammonia precursor at 14, into the upper region (12) of a furnace (10). This produces the reaction of equation (1) in Table 1. The optimum temperature for $NO_X$ reduction is about 1,800° F. Injection at higher temperatures causes ammonia to decompose to $NO_X$, which is undesirable since $NO_X$ reduction is the purpose of SNCR. Injection at lower temperatures increases ammonia slip. Ammonia slip is undesirable in SNCR processes because it has been shown to lead to ammonia bisulfate ($NH_4HSO_4$) formation (equation 4). Ammonium bisulfate is very corrosive and is known to condense at temperatures below

TABLE 1

IMPORTANT CHEMICAL REACTIONS

Furnace (desirable) - 1,600°-2,200° F.

$$4NH_3 + 4NO + O_2 \longrightarrow 4N_2 + 6H_2O \quad (1)$$

$$CaCO_3 + SO_2 + \tfrac{1}{2}O_2 \xrightarrow{heat} CaSO_4 + CO_2 \quad (2)$$

calcium sulfate $$CaCO_3 + SO_3 \xrightarrow{heat} CaSO_4 + CO_2 \quad (3)$$

Air Heater - <350° F.

$$NH_3 + SO_3 + H_2O \longrightarrow NH_4HSO_4 \text{ (undesirable)} \quad (4)$$

ammonium bisulfate $$2NH_3 + SO_3 + H_2O \longrightarrow (NH_4)_2SO_4 \text{ (desirable)} \quad (5)$$

ammonium sulfate

Dry Scrubber (desirable) - <300° F.

$$2NH_3 + H_2O + SO_2 \longrightarrow (NH_4)_2SO_3 \quad (6)$$

ammonium sulfite or . . .

$$NH_3 + H_2O + SO_2 \longrightarrow NH_4HSO_3 \quad (7)$$

ammonium bisulfite

TABLE 1-continued

| IMPORTANT CHEMICAL REACTIONS | |
|---|---|
| $Ca(OH)_2 + SO_2 \longrightarrow CaSO_3 + H_2O$ (calcium sulfite) | (8) |
| Baghouse (desirable) - ~140° F. See equations 6, 7 and 8. | |
| Ammonia Regeneration (desirable) - ambient | |
| In an alkaline solution: | |
| $Ca(OH)_2 + NH_4HSO_3 \longrightarrow CaSO_3 + NH_{3(g)} + 2H_2O$ (ammonium bisulfite) | (9) |
| $Ca(OH)_2 + (NH_4)_2SO_3 \longrightarrow CaSO_3 + 2NH_{3(g)} + 2H_2O$ (ammonium sulfite) | (10) |

350° F., as found in most air heaters (17). The formation of ammonium bisulfate can be controlled by reducing the $SO_3$ concentration, or by having a high excess of ammonia. A high excess of ammonia favors ammonium sulfate ($[NH_4]_2SO_4$) formation (equation 5), which does not lead to air heater fouling. Other detrimental effects of ammonia slip on the SNCR process are that it has been shown to lead to odor problems and a white plume at the stack.

LIDS is an $SO_2$ control technology that involves furnace limestone ($CaCO_3$) injection at (16) followed by dry scrubbing at (18). $SO_2$ removal occurs at both stages for greater total efficiency (equations 2, 3, and 8). The optimum temperature for limestone injection is about 2,200° F. in the upper region (20) of furnace (10). Injection at higher temperatures causes dead burning, which decreases sorbent reactivity. Injection at lower temperatures inhibits calcination which also reduces sorbent reactivity. One of the main features of LIDS is that a portion of the unreacted sorbent leaving the furnace can be slurried in a tank (28) and recycled to the dry scrubber by a stream (22) to remove more $SO_2$. Additional $SO_2$ removal occurs in the particulate control device (24), especially if a baghouse is used.

The combined process, hereafter referred to as $A^+$-LIDS, begins with dry limestone injection into the upper furnace at (16) and at a Ca/S stoichiometric ratio of about 1-1.5. Excess calcium in the furnace absorbs $SO_3$, as well as $SO_2$ (Equations 2 and 3), which prevents ammonium bisulfate formation in the air heater and lowers the acid dew point. Unreacted calcium passes through the system to the particulate collector (24) where a portion is recycled at (26) to make slurry in tank (28) for the dry scrubber (18). Additional $SO_2$ removal occurs in the dry scrubber and particulate collector to increase removal efficiency and sorbent utilization (Equation 8).

Furnace limestone injection is closely followed by the addition of excess ammonia to control $NO_X$ at (14) (Equation 1). The best temperature for ammonia injection in the $A^+$-LIDS process will probably be slightly lower than the optimum temperature for an SNCR process to prevent decomposition to $NO_X$. Excess ammonia in the furnace increases $NO_X$ removal and inhibits ammonium bisulfate formation by favoring ammonium sulfate ($[NH_4]_2SO_4$) formation (Equation 5).

Unreacted ammonia passes through the system to the dry scrubber (18), or similar system, and it is here that the greatest advantage of combining the two technologies is realized. Tests have shown that ammonia reacts quantitatively with $SO_2$ to increase the overall removal efficiency (Equations 6 and 7). The reaction has been shown to produce extremely high ammonia utilization, near 100%, as long as some $SO_2$ remains. Therefore, it should be possible to obtain high levels of $SO_2$ removal, with virtually no ammonia emission at the stack.

There is also data that indicates that ammonia can be recovered from the baghouse ash by mixing the ash in an ammonia regeneration chamber (30) with a small quantity of water at (32). In an alkaline environment, calcium displaces the ammonia in ammonium salts releasing ammonia gas (Equations 9 and 10). The system could recycle this ammonia at (34) to the scrubber or at (36) to the furnace to further improve sorbent utilization.

In the following, the problems encountered with SNCR and LIDS and how they are solved by combining the technologies are disclosed. Other non-obvious advantages are also included.

SNCR—$NO_X$ REMOVAL

The combustion of coal is known to produce oxides of nitrogen that have been identified as precursors to acid rain. Utilities must control $NO_X$ emissions and are penalized for not meeting ever tighter $NO_X$ emission limits.

Injecting ammonia, or any ammonia precursor, into the furnace at about 1,800° F. has been shown to reduce $NO_X$ emissions by 50% or greater. However, SNCR is faced with several problems including ammonium bisulfate formation, which fouls air heaters, and ammonia slip, which causes odor problems and white plumes. By combining SNCR with LIDS, the problems with SNCR can be eliminated, as described below, and $NO_X$ reduction efficiency can be increased by injecting higher levels of ammonia.

SNCR—AIR HEATER FOULING CAUSED BY AMMONIUM BISULFATE FORMATION AND CONDENSATION

Ammonium bisulfate is known to form during the SNCR process below 350° F. if the relative ratio of $NH_3$ to $SO_3$ is near or below one (Equation 4). If this ratio can be maintained above one; that is, by increasing the ammonium concentration or by decreasing the $SO_3$ concentration, the kinetics favor the formation of ammonium sulfate (Equation 5). Ammonium sulfate does not foul air heater surfaces.

Injecting excess ammonia in the furnace is an integral part of $A^+$-LIDS because ammonia is needed later in the process for $SO_2$ removal. The non-obvious feature of injecting excess ammonia at 1,800° F. is that it reduces the likelihood of bisulfate formation while increasing $NO_X$ removal in the furnace. $NO_X$ reductions in excess of 50% are expected for this technology. The likelihood of ammonium bisulfate formation is further decreased because the calcium based sorbent injected in the furnace will absorb most of the $SO_3$.

SNCR—Ammonia Utilization and Slip

Ammonia slip is a great concern for utilities considering SNCR because of odor problems, white plume formation, and the threat of bisulfate formation. The current procedure is to operate SNCR systems at $NH_3/NO_X$ ratios below one to prevent slip, or to inject at temperatures above the optimum so that excess ammonia decomposes to $NO_X$. Both methods reduce system efficiency and limit the practical $NO_X$ reduction capability to around 50%.

Combining SNCR with LIDS turns one of SNCR's greatest disadvantages into a necessary advantage. A+-LIDS requires ammonia at the scrubbing step, thereby allowing excess ammonia injection in the furnace at temperatures near the optimum. Excess ammonia in the furnace increases $NO_X$ reduction and ammonia utilization and reduces the likelihood of bisulfate formation.

SNCR—Complicated Injection System

Current SNCR injection systems consist of combinations of complicated, multi-level, high energy injection nozzles and metering systems designed to inject precise amounts of various concentrations of ammonia solutions, containing enhancers, at appropriate stages in the boiler, according to load, in order to prevent ammonia slip and maximize $NO_X$ reduction in the short residence times available. These systems are expensive and require a great deal of fine tuning.

Injecting excess ammonia in the furnace is an integral part of A+-LIDS because ammonia is needed later in the process for $SO_2$ removal. This simplifies the ammonia injection system because it is easier to inject excess ammonia than it is to inject precise amounts. Higher ammonia flow rates also lead to higher jet momentum that increases jet penetration and flue gas mixing. The projected results are increased $NO_X$ removal and ammonia utilization at shorter residence times.

A typical control scheme can be based on maximizing calcium utilization and using only enough ammonia to maintain high levels of $SO_2$ removal. Several factors dictate this type of control scheme. First, ammonia is the more expensive of the two reagents and should, therefore, be used sparingly. Secondly, because calcium utilization is typically below 60%, it is important to operate the system at conditions that maximize calcium utilization (i.e., low scrubber approach temperature, high slurry solids, etc.). Finally, because ammonia utilization will always be near 100%, it is best to use as little as possible. This type of control scheme ensures the lowest operating cost for reagents. It could be implemented by operating all systems at conditions known to produce maximum calcium utilization and then controlling the ammonia flow to the furnace to maintain 95% $SO_2$ removal. An alternative would be to monitor for ammonia at the stack and adjust the feed rate accordingly.

LIDS—$SO_2$ Removal

The combustion of coal is known to produce oxides of sulfur that have been identified as precursors to acid rain. Utilities must control $SO_2$ emissions and are penalized for not meeting ever tighter $SO_2$ emission limits.

The LIDS process has bee demonstrated in a 1.8 MW pilot facility. Results showed that greater than 90% $SO_2$ removal is possible with high sulfur coal at a furnace Ca/S ratio of 2, a scrubber approach to saturation temperature ($T_{as}$) of 20° F., and using a baghouse for particulate control. Combining LIDS and SNCR should increase $SO_2$ removal efficiencies to about 95% because of the $NH_3$—$SO_2$ reactions that take place in the scrubber (Equations 6 and 7) and increase calcium utilization to above 60% (Equations 9 and 10).

LIDS—Solids Deposition on Scrubber Surfaces

The most difficult problem in the design and operation of dry scrubber systems is the control and handling of solids deposition on interior scrubber surfaces. Deposition occurs when water or slurry droplets impact scrubber surfaces before completely evaporating. It is greatly aggravated at the low approach to saturation temperatures needed to achieve high levels of $SO_2$ removal. There are many causes for deposition including poor inlet gas flow or temperature distribution, recirculation zones, poor atomization, insufficient residence time, direct jet impaction, and jet spray maldistribution. B&W's initial commercial dry scrubber can be safely operated at 40° F. $T_{as}$. More recent B&W designs have been operated safely between a 20° and 30° F. $T_{as}$, but this is perceived as "risky" by utilities.

A recent test has shown that ammonia addition ahead of the dry scrubber can be used to maintain 90-95% $SO_2$ removal efficiency at higher $T_{as}$ and lower furnace Ca/S ratio. Typical pilot-scale LIDS data have shown that 90% $SO_2$ removal can be achieved at nominal furnace Ca/S of 2 and a 20° F. $T_{as}$. Preliminary data with ammonia addition, at a scrubber $NH_3S$ ratio of 0.4 and a furnace Ca/S ratio of 2, shows that the scrubber can be operated at a 43° F. $T_{as}$ while maintaining 90% $SO_2$ removal. Combining SNCR and LIDS should produce similar results, and even higher removals may be obtained if the scrubber design allows safe operation near a 20° F. $T_{as}$.

LIDS—Low Sorbent Utilization

Pilot-scale LIDS data has shown that calcium utilization is related to the furnace Ca/S ratio. Tests at a Ca/S ratio of 1.2 yielded 74% $SO_2$ removal for 61% calcium utilization. A Ca/S ratio of 1.9 yielded 92% removal for 48% utilization, and a Ca/S ratio of 2.4 yielded 97% removal for 42% utilization. Clearly, utilization decreases as the Ca/S ratio increases above one.

Recent tests at the University of Tennessee, B&W's E-$SO_X$ Pilot, and B&W's Pilots LIDS Facility have shown that ammonia utilization is near 100%. During a short, non-steady state test at the LIDS pilot, results indicated that 90% $SO_2$ removal was maintained at a nominal furnace Ca/S ratio of 1.0, and a nominal scrubber $NH_3$/S ratio of about 0.2. These results suggest that ammonia can be used to maintain high $SO_2$ removal at more modest Ca/S ratios for better sorbent utilization. Calcium utilization is also increased by the reaction that takes place during ammonia regeneration (Equations 9 and 10).

LIDS—Ash Disposal or Alternate Uses

LIDS greatly increases the amount of solids loading to the particulate control device and the ash handling and disposal systems. Although the waste material is considered non-hazardous, the large increase necessitates that alternative uses be found for this material. Several ongoing projects are investigating potential alternative uses.

Preliminary results have shown that ammonia addition has the potential to reduce the amount of fresh limestone added to the furnace by a factor of two (see above). This greatly reduces the dust loading to the particulate collector and the amount of waste generated by the system.

Ammonia reacts in the dry scrubber to produce ammonium sulfite and ammonium bisulfite (the exact mechanism is unclear at this time). These ammonia compounds, along with the calcium and magnesium compounds, are familiar constituents of fertilizer.

Finally, there is data that indicates that ammonia can be recovered from the waste product and reused. Research at the University of Tennessee suggests that ammonia gas is released from the waste material when it is mixed with water (Equations 9 and 10). A separate vessel, like a pug mill, could be used to mix the baghouse ash with small quantities of water. The off-gas could be drawn from the vessel and reinjected into the dry scrubber or furnace. The moistened ash could then be more safely handled for disposal or recycled to the slurry tank. Recycling the ammonia further enhances sorbent utilization.

LIDS—Degradation of Particulate Collector Performance By Increased Loading and a Larger Amount of Fines As stated above, LIDS greatly increases the dust loading to the particulate control device. Also, ammonia injection alone is known to produce extremely fine fumes of sulfite and sulfate compounds that are difficult to collect. The addition of calcium to absorb $SO_3$ also lowers ash resistivity making the ash difficult to collect in an electrostatic precipitator (ESP).

As previously stated, results have shown that ammonia addition has the potential to reduce the amount of limestone requirement by a factor of two. The same tests have also shown that the fine ammonia compounds can be easily collected in baghouse because they are mixed with larger particulate. The net effect of combining SNCR with LIDS is, therefore, an increase in collection efficiency caused by reduced ash loading. Humidification is also known to make up for $SO_3$ depletion in ESP's. Experience has shown that ESP performance can be maintained with low levels of humidification. The dry scrubber in the $A^+$-LIDS process provides sufficient humidification to maintain ESP performance.

LIDS—Boiler Efficiency Decrease Caused by Tube Fouling

Fouling of boiler tube surfaces can be caused or aggravated by LIDS. Utilities are concerned that the addition of limestone into the upper furnace can cause tube fouling that would result in increased soot blowing and decreased heat cycle efficiency.

Recent LIMB testing at the Ohio Edison's Edgewater Station has shown that tube fouling may be related to grind size. Three limestone sizes were tested: a commercial grind (30 $\mu$ median diameter), a fine grind (12 $\mu$), and a special super fine grind (3.5 $\mu$). Results showed that the commercial material actually prevented tube fouling and eliminated the need for soot blowing. The medium grind caused slight fouling, but not higher than normal. The super fine grind caused some fouling, but still less than observed with hydrated lime injection. The respective furnace $SO_2$ removal efficiencies were about 25%, 35%, 45%. The relative cost ranged from inexpensive for the commercial grade to very expensive for the super fine material. These results suggest that by combining SNCR with LIDS, a high overall level of $SO_2$ removal could be maintained with commercial grate limestone. This would have the added advantage of a lower cost reagent as well as increasing the heat cycle efficiency and reducing soot blower maintenance costs. However, care must be taken not to choose a limestone grind size that increases tube erosion. Combining LIDS and SNCR is also expected to reduce sorbent usage which will also decrease the potential for fouling.

GENERAL—Air heater Fouling and Corrosion by $SO_3$ Condensation

Fouling and corrosion of air heater tubes occurs when the air heater gas temperatures fall below the acid dew point. Current practices dictate that air heater exit gas temperatures remain above about 300° F. to prevent $SO_3$ condensation.

Calcium is known to react with $SO_3$ at furnace temperatures. Therefore, the $A^+$-LIDS process has the added benefit of reducing the $SO_3$ concentrations and eliminating the threat of air heater fouling and corrosion by acid condensation. By lowering the acid dew point, $A^+$-LIDS will also enable utilities to operate the air heater at a lower exit gas temperature, thereby increasing the efficiency of the boiler heat cycle. An increase of about ½% is possible for each 20° F. decrease in air heater exit gas temperature.

The $A^+$-LIDS process has many unexpected and useful features that stem from the integration of two technologies. The advantages gained by combining SNCR and LIDS go far beyond what is possible with the individual technologies and include:

1. >90% $SO_2$ removal;
2. 50% $NO_X$ removal with $A^+$-LIDS (more if combined with low $NO_X$ burners, reburning, etc.);
3. Low-cost sorbents (i.e., ammonia and commercial grade limestone);
4. No bisulfate fouling of the air heater;
5. No $SO_3$ condensation in the air heater or other duct work;
6. Furnace ammonia slip is turned from a disadvantage to an advantage;
7. A simplified ammonia injection system;
8. The ability to maintain high $SO_2$ removal at higher scrubber approach temperatures, if necessary;
9. High sorbent utilization;
10. The possible production of a regeneratable, salable waste product;
11. Increased baghouse performance;
12. No convective pass tube fouling;
13. No need for additional soot blowing and a possible reduction of soot blowing cycles;
14. Increased heat cycle efficiency; and
15. Relatively easy retrofit.

While a specific embodiment of the invention has been shown and described in detail to illustrate the application of the principles of the invention, it will be understood that the invention may be embodied otherwise without departing from such principles.

What is claimed is:

1. A process for the simultaneous removal of $NO_X$ and $SO_X$ from the exhaust of a furnace having a combustion region where $NO_X$ and $SO_X$ are formed, a first injection region at a temperature of about 2,000°-2,400° F. and a second injection region at a temperature of about 1,600°-2,000° F., the process comprising the steps of:

injecting a calcium based sorbent into the first injection region in an amount sufficient to absorb at least some $SO_X$ generated in the combustion region;

injecting ammonia or ammonia precursor into the second injection region in an amount sufficient to react with and reduce at least some of the $NO_X$ generated in the combustion region, to produce an exhaust containing gas and particulate;

supplying the exhaust to a dry scrubber where unabsorbed $SO_X$ reacts with the calcium based sorbent and unreacted ammonia;

supplying an output from the dry scrubber to a particulate collector for separating particulate from gas; and recycling at least some of the particulate to a slurry tank where unused calcium containing sorbent is returned to the dry scrubber to absorb additional $SO_2$.

2. A process according to claim 1, including adding water to the particulate removed from the particulate collector to regenerate ammonia, and returning the generated ammonia to the dry scrubber or furnace.

3. A process according to claim 1, including injecting sufficient sorbent, to establish a Ca/S molar ratio of 1 to 1.5.

4. A process according to claim 3, including injecting excess ammonia or ammonia precursor, into the second injection region.

5. An apparatus for simultaneously removing $NO_X$ and $SO_X$ from the exhaust from a furnace having a combustion region where $NO_X$ and $SO_X$ are formed, a first injection region which is at a temperature of about 2,000°-2,400° F. and a second injection region which is at a temperature of about 1,600°-2,000° F., the apparatus comprising:

first injector means for injecting a calcium based sorbent into the first injection region in an amount sufficient to absorb at least some $SO_X$ generated in the combustion region;

second injector means for injecting into the second region an ammonia or an ammonia precursor in an amount sufficient to react with at least some of the $NO_X$ generated in the combustion region, to produce an exhaust containing gas and particulate in the furnace;

a dry scrubber connected to the furnace for receiving the exhaust and wherein unabsorbed $SO_2$ reacts wit the calcium based sorbent and unreacted ammonia to produce an output; and collector means connected to the dry scrubber for receiving the output of the dry scrubber and for separating particulate from gas in the output, the collector means including an outlet for particulate and an outlet for gas, and a slurry tank connected to the outlet for particulate, for recycling sorbent to the dry scrubber.

6. An apparatus according to claim 5, wherein the collector comprises a baghouse.

7. An apparatus according to claim 5, wherein the collector includes an outlet for particulate and an outlet for gas, an ammonia regenerator connected to the outlet for ash, means for supplying water to the ammonia regenerator to produce regenerated ammonia, the ammonia regenerator being connected to the dry scrubber or furnace for recycling the regenerated ammonia to either system.

* * * * *